US010796651B2

(12) United States Patent
Kang

(10) Patent No.: US 10,796,651 B2
(45) Date of Patent: Oct. 6, 2020

(54) DRIVING METHOD AND DEVICE OF DISPLAY PANEL, AND DISPLAY DEVICE

(71) Applicants: Chongqing HKC Optoelectronics Technology Co., Ltd., Chongqing (CN); HKC Corporation Limited, Shenzhen, Guangdong (CN)

(72) Inventor: Chihtsung Kang, Chongqing (CN)

(73) Assignees: Chongqing HKC Optoelectronics Technology Co., Ltd., Chongqing (CN); HKC Corporation Limited, Shenzhen (CN)

( * ) Notice: Subject to any disclaimer, the term of this patent is extended or adjusted under 35 U.S.C. 154(b) by 0 days.

(21) Appl. No.: 16/241,986

(22) Filed: Jan. 7, 2019

(65) Prior Publication Data

US 2020/0090606 A1 Mar. 19, 2020

Related U.S. Application Data

(63) Continuation of application No. PCT/CN2018/111829, filed on Oct. 25, 2018.

(30) Foreign Application Priority Data

Sep. 13, 2018 (CN) ..... 2018 1 1072392

(51) Int. Cl.
*G09G 3/18* (2006.01)
*G09G 3/36* (2006.01)

(52) U.S. Cl.
CPC ..... *G09G 3/3614* (2013.01); *G09G 3/3607* (2013.01); *G09G 3/3685* (2013.01); *G09G 2300/0452* (2013.01); *G09G 2310/08* (2013.01); *G09G 2320/0242* (2013.01); *G09G 2330/021* (2013.01)

(58) Field of Classification Search
USPC ... 345/54, 690, 691, 204, 209, 212, 213, 89, 345/174, 55, 210, 103, 96
See application file for complete search history.

(56) References Cited

U.S. PATENT DOCUMENTS

| | | | | |
|---|---|---|---|---|
| 8,462,282 | B2 | 6/2013 | Chen et al. | |
| 2007/0097054 | A1* | 5/2007 | Cheng | G09G 3/3648 345/96 |
| 2008/0106541 | A1* | 5/2008 | Yamazaki | G09G 3/3614 345/212 |
| 2009/0195562 | A1* | 8/2009 | Huang | G09G 3/2003 345/690 |

(Continued)

FOREIGN PATENT DOCUMENTS

| | | | |
|---|---|---|---|
| CN | 1924647 | A | 3/2007 |
| CN | 101620329 | A | 1/2010 |

(Continued)

*Primary Examiner* — Thuy N Pardo

(57) ABSTRACT

Disclosed a driving method and a device of display panel, as well as a display panel, taking a time duration of scanning at least three adjacent columns of pixel unit as a driving period, driving a common electrode of each sub-pixel of the pixel unit with a preset voltage in a current driving period, and if the preset voltage is a positive or negative polarity driving voltage, driving the high voltage sub-pixels of the pixel and the low voltage sub-pixels of the pixel unit with a preset driving mode.

19 Claims, 6 Drawing Sheets

(56) References Cited

U.S. PATENT DOCUMENTS

2010/0238105 A1* 9/2010 Matsushima ..... G09G 3/3648 345/102
2010/0245336 A1* 9/2010 Zhang ..... G09G 3/3611 345/213
2010/0271359 A1* 10/2010 Takeuchi ..... G09G 3/3655 345/209
2010/0328285 A1* 12/2010 Jarupoonphol ..... G09G 3/3655 345/209
2012/0194574 A1* 8/2012 Goto ..... G09G 3/3688 345/690
2012/0327135 A1 12/2012 Kitayama et al.
2013/0088528 A1* 4/2013 Borgers ..... G09G 3/3648 345/690
2013/0194170 A1* 8/2013 Saitoh ..... G09G 3/3611 345/103
2014/0132645 A1* 5/2014 Goto ..... G09G 3/3696 345/690
2014/0168184 A1* 6/2014 Kim ..... G09G 3/3258 345/209
2015/0091883 A1* 4/2015 Pyun ..... G09G 3/2074 345/204
2016/0092027 A1* 3/2016 Lee ..... G06F 3/044 345/174
2016/0155393 A1* 6/2016 Jung ..... G02F 1/136213 345/89
2016/0247825 A1* 8/2016 Katsuta ..... H01L 27/124 345/54
2017/0060302 A1* 3/2017 Yang ..... G06F 3/0412 345/54
2017/0140721 A1 5/2017 Chen
2017/0154561 A1* 6/2017 He ..... G02F 1/133512 345/96
2017/0263170 A1* 9/2017 Mu ..... G09G 3/3614 345/55
2017/0322468 A1* 11/2017 Kim ..... G02F 1/133345 345/690
2018/0157096 A1* 6/2018 Guo ..... G09G 3/3614 345/54
2018/0211617 A1* 7/2018 Li ..... G09G 3/3685 345/691
2018/0260061 A1* 9/2018 Hirota ..... G02F 1/13338 345/55
2018/0277570 A1* 9/2018 Katsuta ..... G02F 1/134363 345/54
2018/0314356 A1* 11/2018 Chen ..... G06F 3/0416 345/54
2018/0314371 A1* 11/2018 Jin ..... G02F 1/13338 345/55
2018/0357963 A1* 12/2018 Gai ..... G09G 3/3233 345/55

FOREIGN PATENT DOCUMENTS

CN 103760725 A 4/2014
CN 104834138 A 8/2015
CN 105182649 A 12/2015
CN 106652944 A 5/2017
CN 107255894 A 10/2017
CN 107301851 A 10/2017
CN 107833561 A 3/2018
CN 107833563 A 3/2018
CN 108107634 A 6/2018

* cited by examiner

DRIVING METHOD AND DEVICE OF DISPLAY PANEL, AND DISPLAY DEVICE

CROSS REFERENCE TO RELATED APPLICATIONS

The present application is a Continuation Application of PCT Application No. PCT/CN2018/11829 filed on Oct. 25, 2018, which claims the benefit of Chinese Patent Application No. 201811072392.7 filed on Sep. 13, 2018. All the above are hereby incorporated by reference.

TECHNICAL FIELD

The present disclosure relates to the field of display technology, and more particularly relates to a driving method and device of display panel, and a display device.

BACKGROUND

Large size liquid crystal display panels are mostly configured in vertical alignment (VA) type or in coplanar switching (IPS) type. Compared with IPS liquid crystal technology, VA type liquid crystal technology has the advantages of high production efficiency and low manufacturing cost, and also has the obvious defects in optical properties, such as color shift when large viewing angle images are presented.

When displaying an image, the brightness of a pixel should ideally change linearly with the voltage change, so that the driving voltage of the pixel can accurately represent the gray scale of the pixel and be reflected by the brightness. As shown in FIG. 1*a*, when VA type liquid crystal technology is used and the display screen is viewed from a smaller angle of view (e.g., front view), the brightness of the pixel can meet the ideal situation, i.e., it changes linearly with voltage, as shown by the ideal curve in FIG. 1*a*. However, when viewing the display screen at a larger viewing angle (e.g., 160 degrees or more to the display screen), due to the limitation of VA type liquid crystal technology, the brightness of the pixel appears to saturate rapidly with the voltage and then changes slowly, as shown in the actual curve in FIG. 1*a*. As a result, the gray scale that the driving voltage should have presented at a large viewing angle has seriously deviated, i.e. has a color shift.

The traditional way to improve color shift is to subdivide each sub-pixel into a main pixel and a subpixel, then the main pixel is driven with a relatively high driving voltage and the subpixel is driven with a relatively low driving voltage. One sub-pixel are displayed by the main pixel and the subpixel together. The relatively high driving voltage and the relatively low driving voltage can maintain a constant relationship between brightness and corresponding gray scale at the front viewing angle when driving the main pixel and the subpixel. Generally, in the first half of the gray scale, the main pixel is driven and displayed with a relatively high driving voltage and the subpixel does not display in the manner shown in FIG. 1*b*, and the brightness of the whole sub-pixel is half that of the main pixel. In the second half of the gray scale, the main pixel is driven and displayed with a relatively high driving voltage and the subpixel is driven and displayed with a relatively low driving voltage, and the brightness of the whole sub-pixel is half of the sum of the brightness of the main pixel and the brightness of the subpixel. After this synthesis, the luminance curve at a large viewing angle is the actual curve in FIG. 1*b*, which is closer to ideal curve, so that the color shift under a large viewing angle is improved.

However, the problem with the above method is that double the number of metal traces and driving devices are needed to drive the subpixels, so that the transparent opening area is sacrificed, the light transmittance of the panel is affected, and the cost is also higher.

SUMMARY

The present disclosure provides a driving method and a driving device of display panel, and a display device, as well as a storage medium based on data-based integrated drive circuit, which aims to improve large viewing angle color shift.

In order to achieve the above object, the present disclosure provides a driving method of display panel, the display panel includes a display array, the display array includes pixel units arranged in an array, the pixel unit is alternately arranged by a first pixel unit and a second pixel unit; the method includes:

taking a time duration of scanning at least three adjacent columns of pixel unit as a driving period, driving a common electrode of each sub-pixel of the pixel unit with a preset voltage in a current driving period;

if the preset voltage is a negative polarity driving voltage, driving the high voltage sub-pixels of the pixel unit with a positive polarity and driving the low voltage sub-pixels of the pixel unit with a negative polarity, wherein the preset voltage is less than a reference voltage;

inverting the preset voltage periodically when a received data driving signal input by a data driving circuit is inverted; and if the inverted preset voltage is a positive polarity driving voltage, driving the high voltage sub-pixels of pixel unit with a negative polarity, and driving the low voltage sub-pixels of the pixel unit with a positive polarity, wherein the inverted preset voltage is larger than the reference voltage.

In addition, in order to achieve the above object, the present application also provides a driving device for display panel, the driving device includes a processor and a non-volatile memory, the non-volatile memory stores executable instructions, the processor executes the executable instructions, and the executable instructions includes:

a common electrode driving module, being configured to take a time duration of scanning at least three adjacent columns of pixel unit as a driving period, driving a common electrode of each sub-pixel of the pixel unit with a preset voltage in a current driving period;

the common electrode driving module is further configured to drive the high voltage sub-pixels of the pixel unit with a positive polarity and driving the low voltage sub-pixels of the pixel unit with a negative polarity if the preset voltage is a negative polarity driving voltage, wherein the preset voltage is less than a reference voltage;

an inverting module, being configured to invert the preset voltage periodically when a received data driving signal input by a data driving circuit is inverted; and the common electrode driving module is further configured to drive the high voltage sub-pixels of pixel unit with a negative polarity and drive the low voltage sub-pixels of the pixel unit with a positive polarity if the inverted preset voltage is a positive polarity driving voltage, wherein the inverted preset voltage is larger than the reference voltage.

In addition, in order to achieve the above object, the present application also proposes a display device, and the display device includes a driving device of display panel.

In addition, in order to achieve the above object, the present application also proposes a storage medium in which a driving program of display panel is stored, and when the driving program is executed by a processor, the steps of the driving method of display panel as described above are implemented.

In the present application, at least three rows of pixel units are scanned as driving periods, the common electrode of each sub-pixel in the pixel unit is driven with a preset voltage in the current driving period, and the sub-pixel does not need to be driven with double metal traces and driving devices to achieve the purpose of cost saving, and when the preset electric voltage is a positive and negative polarity driving voltage, the high-voltage sub-pixel and the low-voltage sub-pixel in the pixel unit are driven with a preset driving mode, so that the sub-pixels in the pixel unit are arranged in a way of crossing high and low voltages, thereby achieving the purpose of solving the visual role deviation.

BRIEF DESCRIPTION OF THE ACCOMPANYING DRAWINGS

FIG. 1*a* is a relationship graph between the color shift curve and the ideal curve before improving;

FIG. 1*b* is a relationship graph between the color shift curve and the ideal curve after improving;

FIG. 2 is a schematic structural diagram of a display device of a hardware operating environment of the embodiments in accordance with this disclosure;

FIG. 3*a* is a schematic structural diagram of an exemplary display array;

FIG. 3*b* is a driving timing diagram of an exemplary display array;

FIG. 4*a* is a schematic structural diagram of the display array of an embodiment in accordance with this disclosure;

FIG. 4*b* is a driving timing diagram of the display array of an embodiment in accordance with this disclosure;

Various implementations, functional features, and advantages of this disclosure will now be described in further detail in connection with some illustrative embodiments and the accompanying drawings.

DETAILED DESCRIPTION OF ILLUSTRATIVE EMBODIMENTS

It is understood that the specific embodiments described herein are merely illustrative of the disclosure and are not intended to limit the disclosure.

Figure 1A:
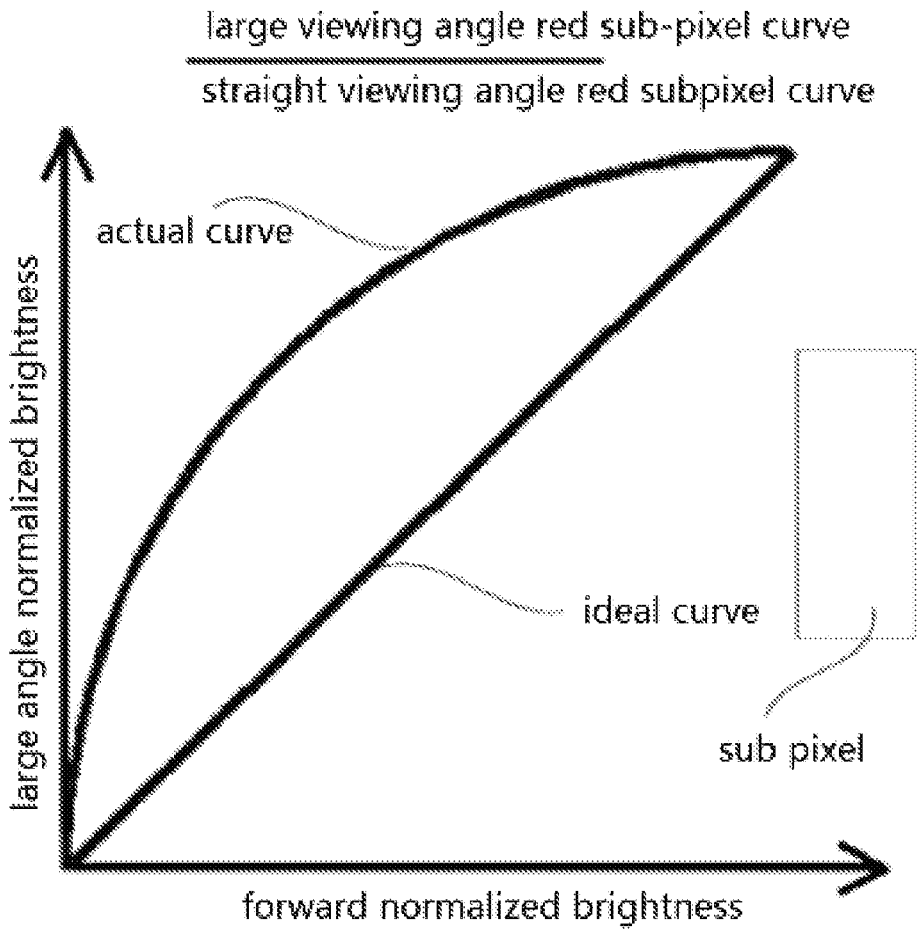
FIG. 1a (Prior Art)
Figure 1B:
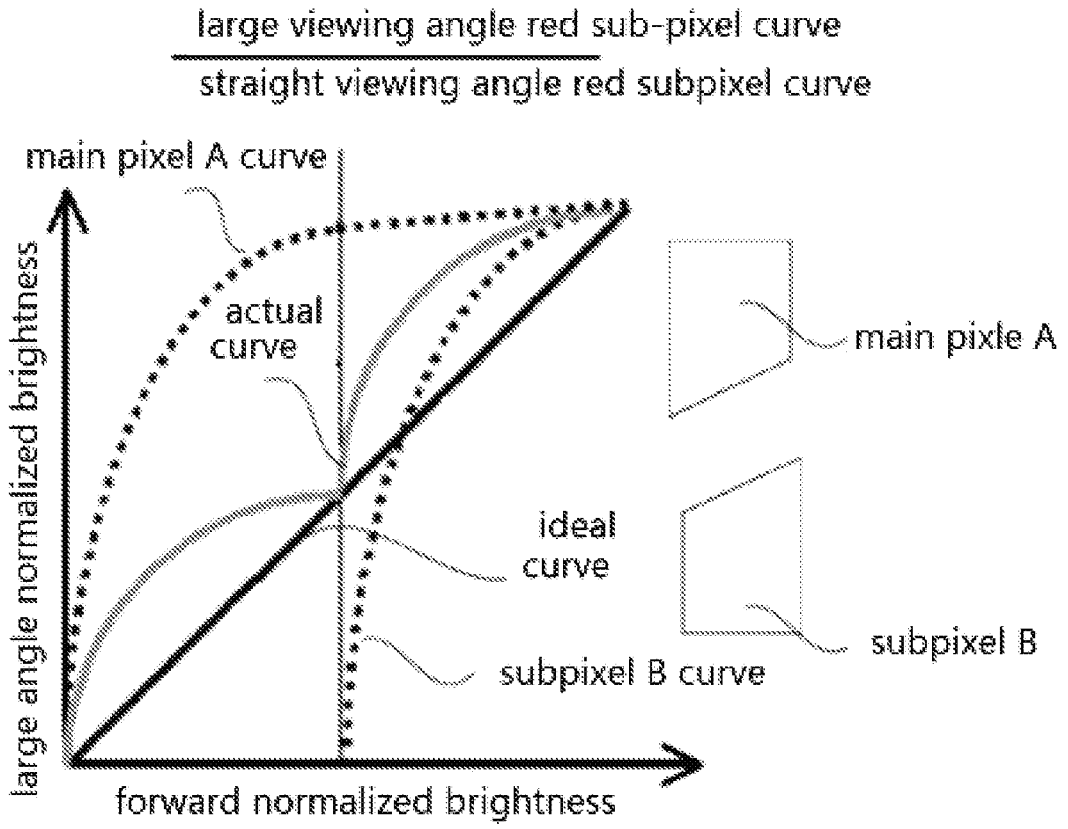
FIG. 1b (Prior Art)
Figure 2:
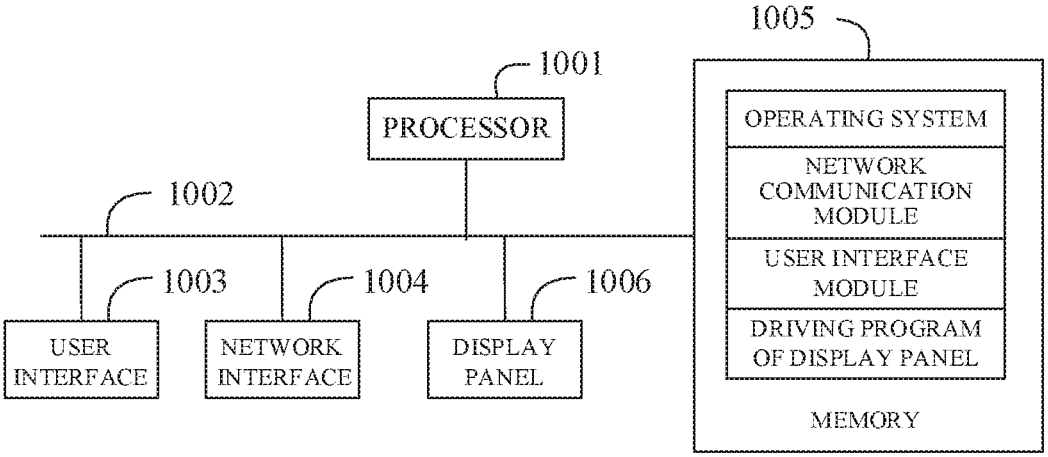

Referring to FIG. 2, FIG. 2 is a schematic structural diagram of a display panel of a hardware operating environment according to an embodiment of the present application.

As shown in FIG. 2, the display panel may include a processor 1001, such as a CPU, a communication bus 1002, user interface 1003, network interface 1004, and memory 1005. The communication bus 1002 is used to implement connection communication between these components. The user interface 1003 may include a display, an input unit such as a keyboard, and the optional user interface 1003 may also include a standard wired interface and a wireless interface. The network interface 1004 may optionally include a standard wired interface, a wireless interface (such as a Wi-Fi interface). The memory 1005 may be a high-speed RAM memory or a non-volatile memory, such as a magnetic disk memory. The memory 1005 may alternatively be a storage device independent of the aforementioned processor 1001, and the display panel 1006 may be a liquid crystal display panel or other display panels capable of performing the same or similar functions.

It will be understood by those skilled in the art that the display panel structure shown in FIG. 2 does not constitute a definition of the display panel and may include more or fewer components than shown, or some components may be combined, or different part arrangements may be used.

As shown in FIG. 2, the memory 1005 as a storage medium may include an operating system, a network communication module, a user interface module, and a driver for a display panel.

In the display panel shown in FIG. 2, the network interface 1004 is mainly used to connect the network and communicate data with the internet; The user interface 1003 is mainly used to connect the user terminal and communicate data with the terminal. The processor 1001 and the memory 1005 in the display panel of the present application may be provided in a data driving integrated circuit that calls the driving sequence of the display panel stored in the memory 1005 through the processor 1001 and performs the operation of the driving method of the display panel.

Based on the above hardware structure, an embodiment of the driving method for the display panel of the present application is proposed.

Figure 3A:
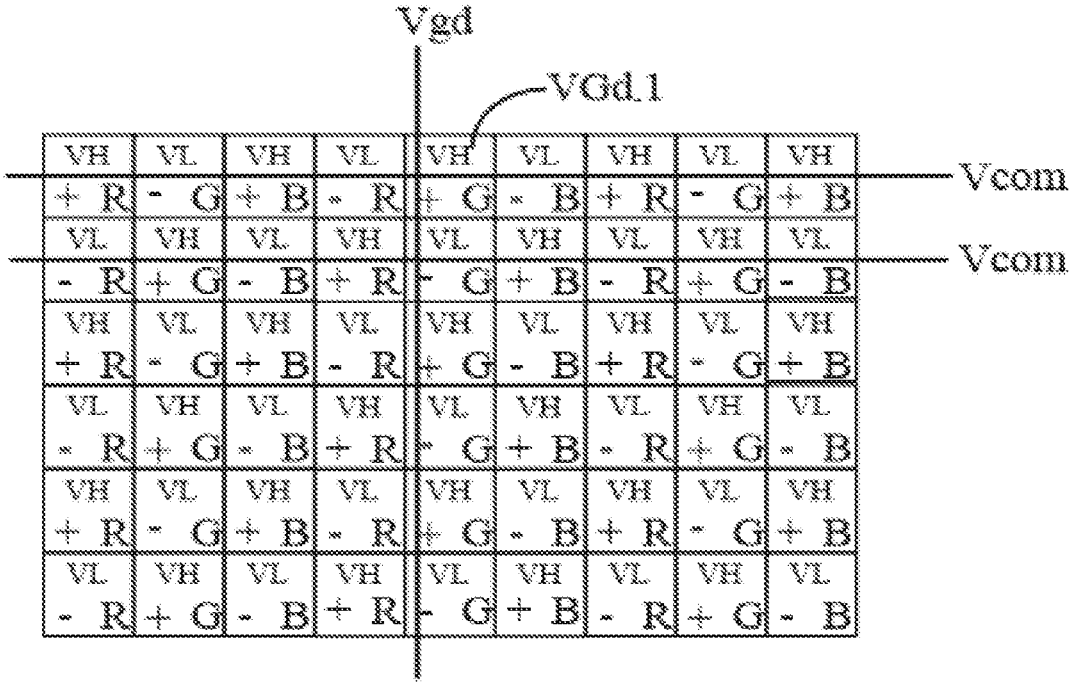
Figure 3B:
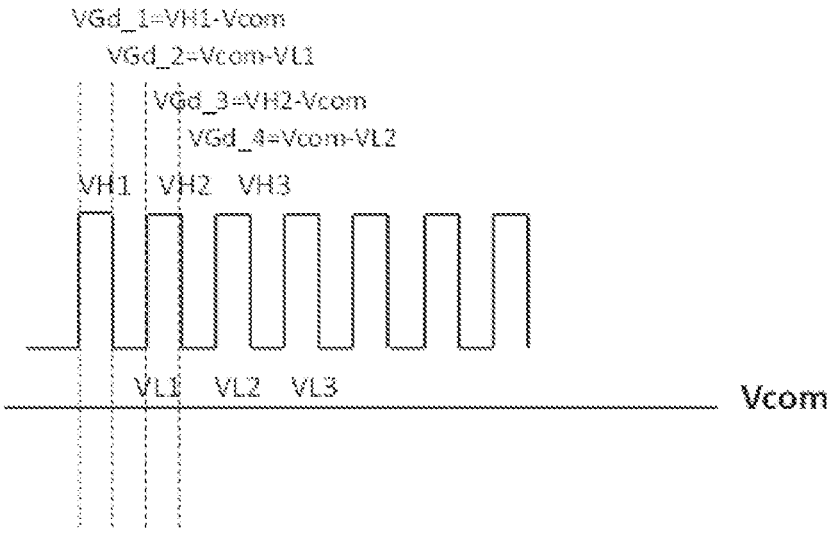

Referring to FIG. 3*a* as an example of the structure of the display array, the common electrode of the original liquid crystal display pixel is designed to pass through the same row of sub-pixels in the same row direction parallel to the gate electrode, as shown in FIG. 3*b* as an example of the driving timing diagram of the display array, the common electrode voltage is a fixed voltage value, and in order to achieve the effect of color shift improvement through high voltage sub-pixels and low voltage sub-pixels, the driving voltage Vd is sequentially driven according to the required voltage of each sub-pixel, as shown in FIG. 3*a*, the equivalent driving voltage VGd_1 of the high voltage sub-pixel is the voltage difference between the driving voltage VH1 and the common electrode Vcom, that is VGd_1=VH1−Vcom. The next adjacent low voltage sub-pixel VGd_2 is the voltage difference between the driving voltage VL1 and the common electrode Vcom, that is, VGd_2=VL1−Vcom, similarly driven by the high voltage and low voltage sub-pixels, as shown in FIG. 3*b*. The voltage driving frequency is VH1, VL1, VH2, VL2 . . . , which is the number of sub-pixel frequency switching of the display column. Therefore, if the display increases with the resolution, the voltage driving frequency of the driving voltage of the same row of pixels will increase. Since the driving signals of the high-voltage sub-pixels and the low-voltage sub-pixels are different, if the adjacent sub-pixels adopt the traditional positive and negative polarity driving method, the driving amplitude of the adjacent sub-pixels will increase, the driving frequency will increase and the driving amplitude will directly cause the power consumption and temperature of driving IC to increase, and the charging ability of pixel formation may decrease, directly reflecting the decrease of the brightness of the panel.

Figure 4A:
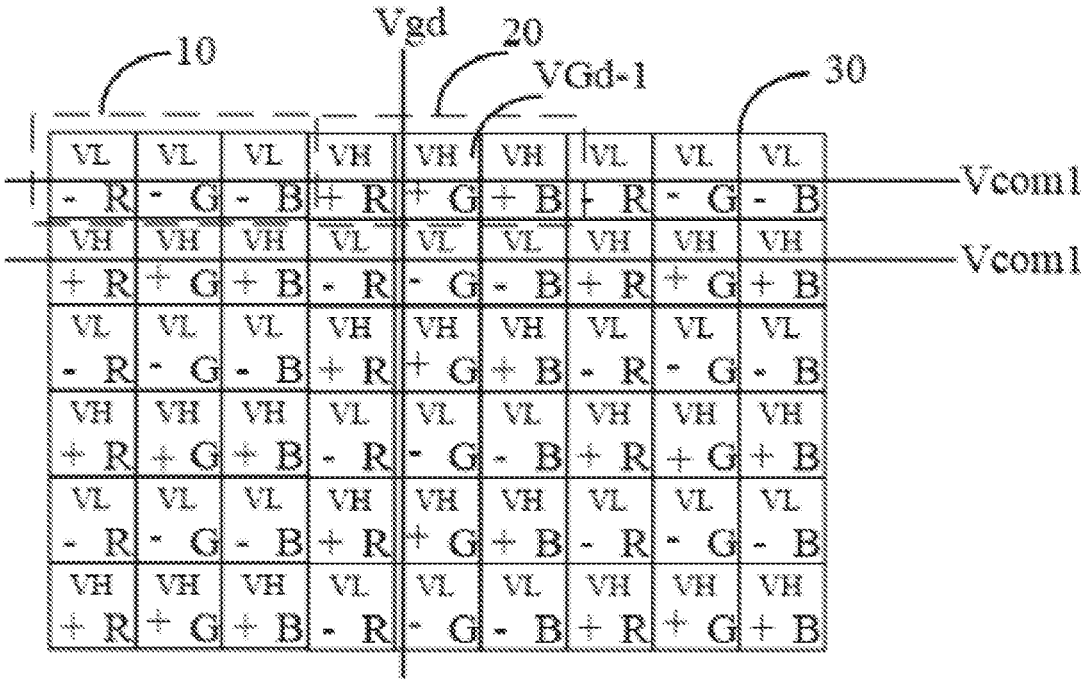
Figure 4B:
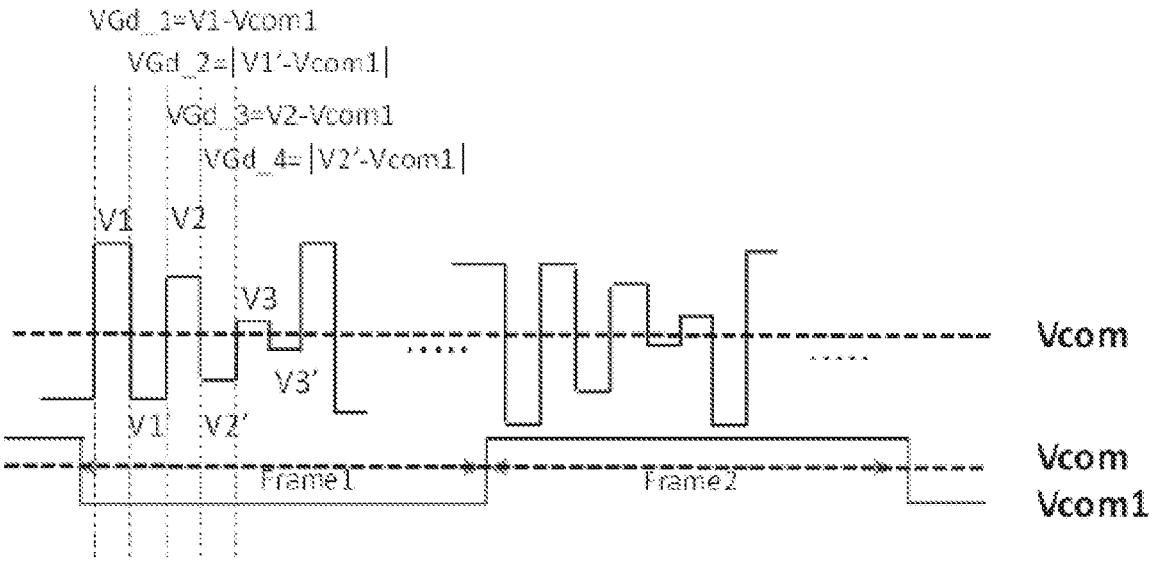

Reference is made to FIG. 4*a*, which is a structural diagram of an embodiment of the display array. FIG. 4*b* is a driving timing diagram corresponding to the display array of this embodiment. The display panel of the display array 30 may be a liquid crystal display panel or other display panels capable of realizing the same or similar functions. This embodiment is not limited to this. In this embodiment, the liquid crystal display panel is taken as an example, the display panel includes a display array including pixel cells arranged in an array, and the pixel cells include a first pixel cell 10 and a second pixel cell 20. The first pixel unit 10 and the second pixel unit 20 are alternately arranged in a row direction and a column direction, and the first pixel unit 10 and the second pixel unit 20 respectively include a first sub-pixel, a second sub-pixel and a third sub-pixel, wherein the first sub-pixel, the second sub-pixel, and the third sub-pixel respectively correspond to a red sub-pixel (R), a green sub-pixel (G), and a blue sub-pixel (B). The sub-pixels in the first pixel unit are opposite in polarity to the sub-pixels in the second pixel unit.

Figure 5:
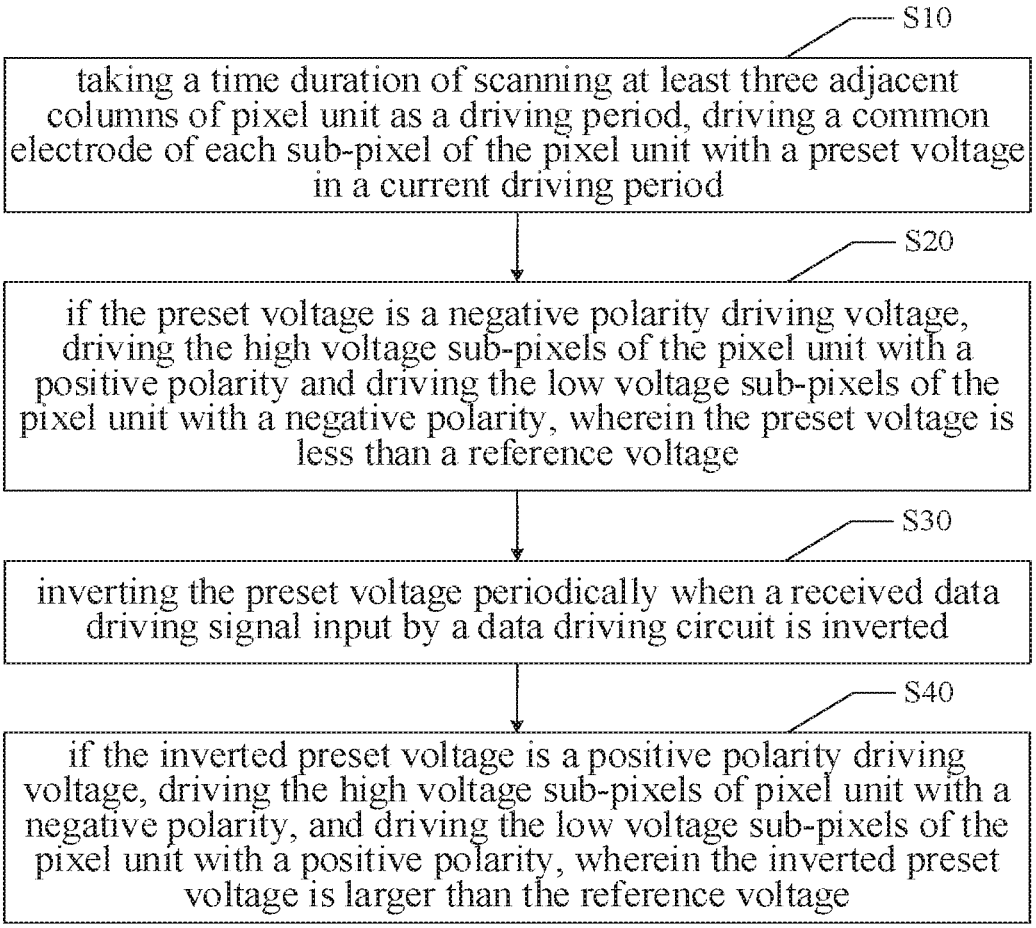
FIG. 5 is a flowchart of an embodiment of the driving method of display panel in accordance with this disclosure.

Referring to FIG. 5, FIG. 5 is a flowchart of the first embodiment of the driving method of the display panel of the present application.

In the first embodiment, the driving method of the display panel includes the following steps:

Step S10, taking a time duration of scanning at least three adjacent columns of pixel unit as a driving period, driving a common electrode of each sub-pixel of the pixel unit with a preset voltage in a current driving period.

As shown in FIG. 4*a*, a preset voltage Vcom1 is input to the common electrode of the sub-pixels in the pixel unit, and the preset voltage can be inverted according to the inversion of the data driving signal. when the preset voltage is positive driving, the preset voltage is greater than the reference voltage, i.e., greater than the original common electrode voltage Vcom, and when the preset voltage is switched to negative driving, the switched preset voltage is less than the reference voltage, thereby realizing positive driving and negative polarity are alternately driven.

It should be noted that in this embodiment, three columns of pixel cells are used as the driving period, and more pixel cells may be provided for periodic scanning, which is not limited in this embodiment. In this embodiment, three columns of pixel cells are used as the driving period.

Step S20, if the preset voltage is a negative polarity driving voltage, driving the high voltage sub-pixels of the pixel unit with a positive polarity and driving the low voltage sub-pixels of the pixel unit with a negative polarity, wherein the preset voltage is less than a reference voltage.

As shown in FIG. 4*b*, when the current sequence is frame 1, adjacent pixel cells are driven in rows with high and low voltages, frame 1 sequential high voltage pixel cells are driven in positive polarity, low voltage pixel cells are driven in negative polarity, and the common electrode voltage Vcom1 is smaller than the original common electrode voltage Vcom, i.e., Vcom1<Vcom.

Step S30, inverting the preset voltage periodically when a received data driving signal input by a data driving circuit is inverted.

After inversion, the driving voltage of the common electrode is switched from frame 1 to frame 2, the high-voltage pixel unit is driven in a negative polarity, and the low-voltage pixel unit is driven in a positive polarity. in conjunction with the positive voltage driving of the common electrode voltage, the positive polarity of the common electrode voltage, i.e., the common electrode voltage Vcom1, is larger than the original common electrode voltage Vcom, i.e., Vcom1>Vcom.

Referring to FIG. 4*a*, when frame 1 is used, G rows of sub-pixels, R and B rows of sub-pixels are the same, and high-voltage sub-pixels VGd_1, VGd_3, VGd_5 and low-voltage sub-pixels VGd_2, VGd_4, and VGd_6 correspond to a common electrode voltage Vcom1 for negative polarity driving. The voltage, the common electrode voltage negative polarity, that is, the common electrode voltage Vcom1 is smaller than the original common electrode voltage Vcom, that is, Vcom1<Vcom, wherein the high voltage sub-pixels VGd_1, VGd_3, and VGd_5 are positive driving voltages, low voltage sub-pixels VGd_2, VGd_4 VGd_6 is a negative driving voltage.

Step S40, if the inverted preset voltage is a positive polarity driving voltage, driving the high voltage sub-pixels of pixel unit with a negative polarity, and driving the low voltage sub-pixels of the pixel unit with a positive polarity, wherein the inverted preset voltage is larger than the reference voltage.

As shown in FIG. 4*b*, as the two adjacent driving signals are inverted, the common electrode voltage is also switched with the polarity inversion to switch the periodic voltage, that is, the common electrode voltage Vcom1 is switched to the positive driving voltage, and the common electrode voltage is The positive polarity, that is, the common electrode voltage Vcom1 is larger than the original common electrode voltage Vcom, that is, Vcom1>Vcom). Further, the high voltage sub-pixels VGd_1, VGd_3, and VGd_5 are negative polarity driving power (<Vcom), and the low voltage sub-pixels VGd_2, VGd_4, and VGd_6 are positive polarity driving voltages (>Vcom).

In this embodiment, the common electrodes of the sub-pixels in the pixel unit are driven by the same driving voltage, and the sub-pixels with high and low voltages are driven by different driving methods, so that the viewing angle color shift is solved, and the corresponding driving is carried out through the common electrodes, thereby reducing the operation of the driving chip, reducing the power consumption of the driving chip and the risk of temperature rise, and no double metal wiring and driving devices are required to drive the sub-pixels, so as to achieve the purpose of saving cost.

Further, after the step S40, the driving method of the display panel further includes:

Selecting two adjacent sub-pixels in the same row respectively, and driving a high voltage sub-pixel in the selected sub-pixels with the equivalent driving voltage that greater than the equivalent driving voltage of the low voltage sub-pixels in the selected sub-pixels.

In a specific implementation, when the frame 1 frame is timed, the high voltage sub-pixel equivalent driving voltage VGd_1 is the positive polarity driving voltage Vgd=V1 (V1>Vcom) and the negative polarity common electrode electric power Vcom1 (Vcom1<Vcom) Poor, that is, VGd_1=|V1−Vcom1|, the next adjacent low voltage sub-pixel VGd_2 is the negative polarity driving. The voltage difference between the voltage Vgd=V1' (V1'<Vcom) and the negative polarity common electrode electric power Vcom1 (Vcom1<Vcom), that is, VGd_2=|V1'−Vcom1|, so VGd_1>VGd_2. Similarly, high voltage VGd_3 and low voltage sub image VGd_4 drive, high voltage sub-pixel equivalent drive voltage VGd_3 is the positive drive voltage Vgd=V2(V2>Vcom) and the negative voltage common electrode voltage Vcom1 (Vcom1<Vcom), that is, VGd_3=|V2−Vcom1|, the next adjacent low voltage sub-pixel VGd_4 is the negative polarity driving voltage Vgd=V2' (V2'<Vcom) The voltage difference from the negative common electrode electric power Vcom1, that is, VGd_4=|V2'−Vcom1|, so VGd_3>VGd_4. So that adjacent sub-pixels are alternately arranged with high and low voltages, and matched with the display. The sub-pixels in the array adopt the frame inversion driving method, thereby achieving the purpose of reducing the color shift.

Further, the step S20 includes:

Driving a high voltage sub-pixel in the selected sub-pixels with the equivalent driving voltage that is a differential voltage between the driving voltage for positive polarity driving and the preset voltage.

Driving a low voltage sub-pixel in the selected sub-pixels with the equivalent driving voltage that is a differential voltage between the driving voltage for negative polarity driving and the preset voltage.

In a specific implementation, the high voltage sub-pixel equivalent driving voltage VGd_1 is a voltage difference between the positive polarity driving voltage Vgd=V1 (V1>Vcom) and the negative polarity common electrode voltage Vcom1 (Vcom1<Vcom), that is, VGd_1=|V1−Vcom1|, the next adjacent low voltage sub-pixel VGd_2 is the voltage difference between the negative polarity driving voltage Vgd=V1' (V1'<Vcom) and the negative polarity common electrode electric power Vcom1 (Vcom1<Vcom), that is, VGd_2=|V1'−Vcom1|.

Further, before the step S30, the driving method of the display panel further includes:

Respectively driving the data driving signals of the high voltage sub-pixels in the selected sub-pixels and the low voltage sub-pixels in the selected sub-pixels by alternately driving of the positive polarity driving and the negative polarity driving.

As shown in FIG. 4*b*, when the common electrode driving voltage is negative polarity driving, the data driving signals are alternately arranged for positive polarity driving and negative polarity driving, so as to realize driving by inputting high and low alternating driving signals and ensure that each sub-pixel is driven accordingly.

Further, after the step S40, the driving method of the display panel further includes:

Driving an equivalent driving voltage of a high voltage sub-pixel and a low voltage sub-pixel in the selected sub-pixels by a preset data driving signal, and the preset data driving signal is an average signal of driving signals of two adjacent sub-pixels in one original same row.

In a specific implementation, as shown in FIG. 4*b*, the high voltage positive polarity driving signal of the G column Vgd=V1, V2, V3 . . . , the high voltage negative polarity dynamic signal Vgd=V1', V2', V3' . . . (V1, V2, V3 . . . >Vcom, V1', V2', V3' . . . <Vcom).

It should be noted that the equivalent voltages of VGd_1 and VGd_2 are respectively driven by the positive polarity driving voltage Vgd=V1 and negative. The polarity driving voltage Vgd=V1' is driven, and the positive driving voltage V1 and the negative driving voltage V1' can be driven. Preferably, the average signal of the original frame pixel signals Gd1 and Gd2 signals (0 to 255 for the 8-bit drive signal), that is, G1=(Gd1+Gd2)/2, the positive polarity driving voltage V1 corresponding to the G1 signal and the negative polarity driving power voltage V1'. The equivalent voltage of VGd_3 and VGd_4 is driven by positive polarity driving voltage Vgd=V2 and negative polarity respectively. The voltage Vgd=V2' is driven, preferably the average signal of the original pixel signals Gd3 and Gd4 signals (with 8 bit driving signals for the 0~255 signal), that is, G2=(Gd3+Gd4)/2, the positive polarity driving voltage V2 corresponding to the G2 signal and the negative polarity driving voltage V2', thereby reducing the frequency of the driving chip, reducing the operation of the driving chip, and reducing the driving the power consumption of the dynamic chip and the temperature increase risk of the driving chip.

Further, after the step S40, the driving method of the display panel further includes:

Acquiring an inversion signal and selecting sub-pixels in the same column to be driven by frame inversion according to the inversion signal.

In this embodiment, the adjacent sub-pixels are alternately arranged and driven for high and low voltages by the frame inversion driving method, and the problem of viewing angle color shift is solved, and when the data driving signal input by the data driving circuit is inverted, the preset voltage is periodically inverted by the driving method opposite to the data driving signal.

In this embodiment, the common electrode of each sub-pixel in the pixel unit is driven by a preset electric voltage within the current driving period, and the sub-pixel does not need to be driven by double metal wiring and driving devices to achieve the purpose of cost saving. When the preset voltage is a positive and negative polarity driving voltage, the high-voltage sub-pixel and the low-voltage sub-pixel in the pixel unit are driven by a preset driving mode, so that the sub-pixels in the pixel unit are arranged in a high-low voltage crossing mode, thereby achieving the purpose of resolving viewing angle color deviation.

Figure 6:
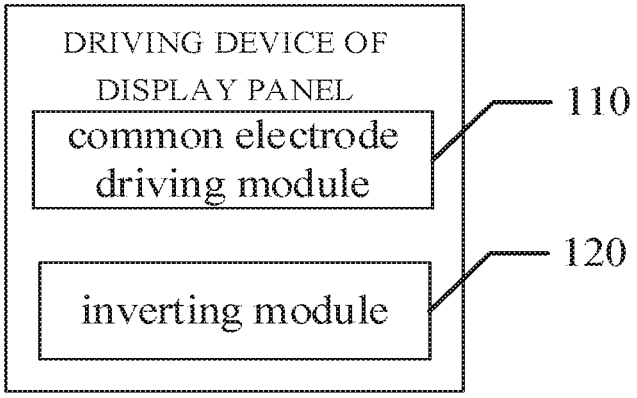
FIG. 6 is a structural diagram of an embodiment of the driving device of display panel in accordance with this disclosure.

In addition, the embodiment of the application also provides a driving device for the display panel. As shown in FIG. 6, the display panel includes a display array including pixel units arranged in an array, which are alternately arranged by a first pixel unit and a second pixel unit; The driving device of the display panel includes:

A common electrode driving module 110, being configured to take a time duration of scanning at least three adjacent columns of pixel unit as a driving period, driving a common electrode of each sub-pixel of the pixel unit with a preset voltage in a current driving period.

The common electrode driving module 110 is further configured to drive the high voltage sub-pixels of the pixel unit with a positive polarity and driving the low voltage sub-pixels of the pixel unit with a negative polarity if the preset voltage is a negative polarity driving voltage, wherein the preset voltage is less than a reference voltage.

An inverting module 120, being configured to invert the preset voltage periodically when a received data driving signal input by a data driving circuit is inverted.

The common electrode driving module 110 is further configured to drive the high voltage sub-pixels of pixel unit with a negative polarity and drive the low voltage sub-pixels of the pixel unit with a positive polarity if the inverted preset voltage is a positive polarity driving voltage, wherein the inverted preset voltage is larger than the reference voltage.

Figure 7:
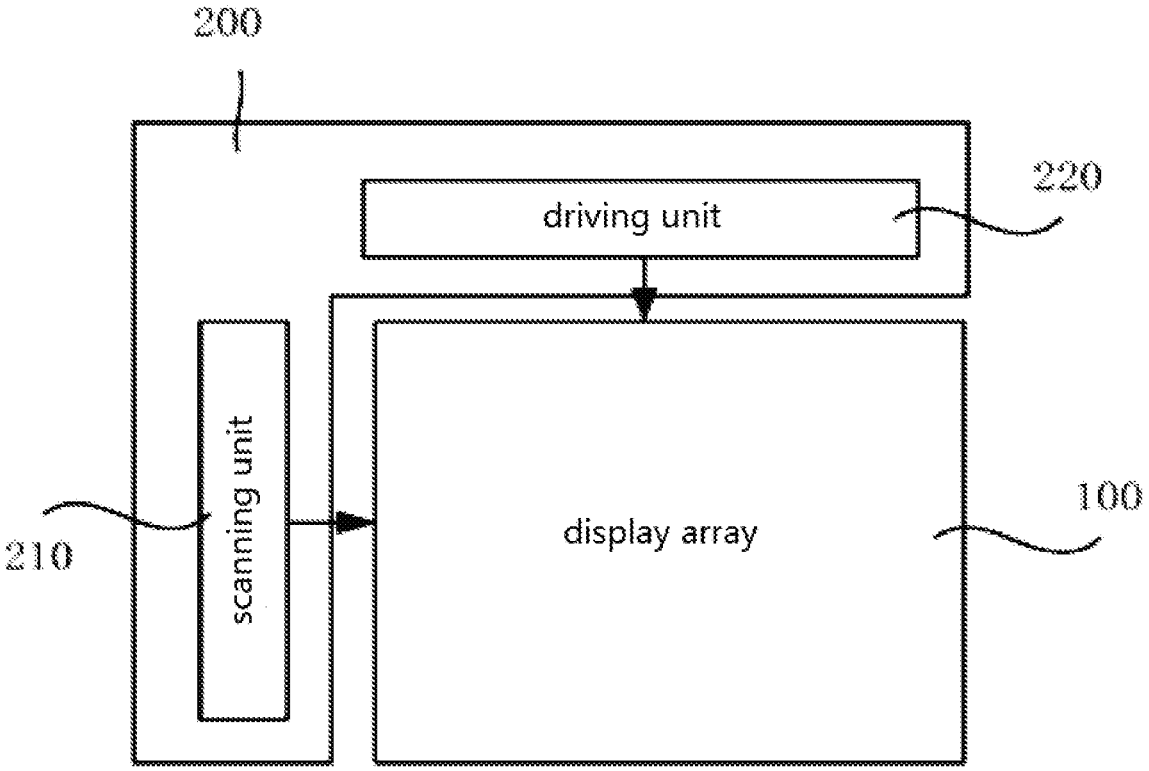
FIG. 7 is a structural diagram of another embodiment of the driving device of display panel in accordance with this disclosure.

As shown in FIG. 7, the driving device of the display panel also includes a display array 100 and a driving module 200, which may include a scanning unit 210 and a driving unit 220. The scanning unit 210 is configured to output scanning signals, typically scanning pixel units line by line, and the driving unit 220 outputs driving signals so that the pixel units receive driving data for display when being scanned.

The driving module 200 can refer to the above embodiment. After this process, the common electrodes of the sub-pixels in the pixel unit can be driven with the same driving voltage, and the sub-pixels with high and low voltages can be driven with different driving methods, so as to solve the viewing angle color shift and correspondingly drive through the common electrodes, thereby reducing the operation of the driving chip, reducing the power consumption of the driving chip and the risk of temperature rise, and achieving the goal of cost saving without doubling the number of metal traces and driving devices to drive the sub-pixels.

In addition, the embodiment of the present application also provides a storage medium on which the driver of the display panel is stored, and when the driver of the display panel is executed by the processor, the driver of the display panel as described above driving method.

The above is only the preferred embodiment of the present application and is not therefore limiting the scope of the patent of the present application. The equivalent structure or equivalent process changes made in the application specification and drawings, or directly or indirectly applied in other related technical fields, are similarly included in the patent protection scope of this application.

What is claimed is:

1. A driving method of display panel, wherein the display panel comprises a display array, the display array comprises pixel units arranged in an array, the pixel unit is alternately arranged by a first pixel unit and a second pixel unit, wherein the first pixel unit and the second pixel unit are high and low voltages with different polarities respectively;

wherein the driving method comprises:

taking a time duration of scanning at least three adjacent columns of pixel unit as a driving period, driving a common electrode of each sub-pixel of the pixel unit with a preset voltage in a current driving period;

if the preset voltage is a negative polarity driving voltage, driving the high voltage sub-pixels of the pixel unit with a positive polarity and driving the low voltage sub-pixels of the pixel unit with a negative polarity, wherein the preset voltage is a negative polarity driving voltage means that the preset voltage is less than a reference voltage;

inverting the preset voltage periodically when a received data driving signal input by a data driving circuit is inverted; and if the inverted preset voltage is a positive polarity driving voltage, driving the high voltage sub-pixels of pixel unit with a negative polarity, and driving the low voltage sub-pixels of the pixel unit with a positive polarity, wherein the inverted preset voltage is a positive polarity driving voltage means that the inverted preset voltage is larger than the reference voltage.

2. The driving method of claim 1, further comprising, subsequent to the operation of if the inverted preset voltage is a positive polarity driving voltage:

selecting two adjacent sub-pixels in the same row respectively, and driving a high voltage sub-pixel in the selected sub-pixels with the equivalent driving voltage that greater than the equivalent driving voltage of the low voltage sub-pixels in the selected sub-pixels.

3. The driving method of claim 2, wherein the operation of if the preset voltage is a negative polarity driving voltage, driving the high voltage sub-pixels of the pixel unit with a positive polarity and driving the low voltage sub-pixels of the pixel unit with a negative polarity comprises:

driving a high voltage sub-pixel in the selected sub-pixels with the equivalent driving voltage that is a differential voltage between the driving voltage for positive polarity driving and the preset voltage; and driving a low voltage sub-pixel in the selected sub-pixels with the equivalent driving voltage that is a differential voltage between the driving voltage for negative polarity driving and the preset voltage.

4. The driving method of claim 2, prior to the operation of inverting the preset voltage periodically when a received data driving signal input by a data driving circuit is inverted, the driving method further comprising:

respectively driving the data driving signals of the high voltage sub-pixels in the selected sub-pixels and the low voltage sub-pixels in the selected sub-pixels by alternately driving of the positive polarity driving and the negative polarity driving.

5. The driving method of claim 2, subsequent to the operation of if the inverted preset voltage is a positive polarity driving voltage, the driving method further comprising:

driving an equivalent driving voltage of a high voltage sub-pixel and a low voltage sub-pixel in the selected sub-pixels by a preset data driving signal, and the preset data driving signal is an average signal of driving signals of two adjacent sub-pixels in one original same row.

6. The driving method of claim 2, subsequent to the operation of if the inverted preset voltage is a positive polarity driving voltage, the driving method further comprising:

acquiring an inversion signal and selecting sub-pixels in the same column to be driven by frame inversion according to the inversion signal.

7. A driving device of display panel, wherein the driving device comprises a processor and a non-volatile memory, the non-volatile memory stores executable instructions, the processor executes the executable instructions, and the executable instructions comprise:

a common electrode driving module, being configured to take a time duration of scanning at least three adjacent columns of pixel unit as a driving period, driving a common electrode of each sub-pixel of the pixel unit with a preset voltage in a current driving period;

the common electrode driving module is further configured to drive the high voltage sub-pixels of the pixel unit with a positive polarity and driving the low voltage sub-pixels of the pixel unit with a negative polarity if the preset voltage is a negative polarity driving voltage, wherein the preset voltage is less than a reference voltage;

an inverting module, being configured to invert the preset voltage periodically when a received data driving signal input by a data driving circuit is inverted; and the common electrode driving module is further configured to drive the high voltage sub-pixels of pixel unit with a negative polarity and drive the low voltage sub-pixels of the pixel unit with a positive polarity if the inverted preset voltage is a positive polarity driving voltage, wherein the inverted preset voltage is larger than the reference voltage.

8. The driving device of claim 7, selecting two adjacent sub-pixels in the same row respectively, and driving a high voltage sub-pixel in the selected sub-pixels with the equivalent driving voltage that greater than the equivalent driving voltage of the low voltage sub-pixels in the selected sub-pixels.

9. The driving device of claim 8, driving a high voltage sub-pixel in the selected sub-pixels with the equivalent driving voltage that is a differential voltage between the driving voltage for positive polarity driving and the preset voltage; and driving a low voltage sub-pixel in the selected sub-pixels with the equivalent driving voltage that is a differential voltage between the driving voltage for negative polarity driving and the preset voltage.

10. The driving device of claim 8, respectively driving the data driving signals of the high voltage sub-pixels in the selected sub-pixels and the low voltage sub-pixels in the selected sub-pixels by alternately driving of the positive polarity driving and the negative polarity driving.

11. The driving device of claim 8, driving an equivalent driving voltage of a high voltage sub-pixel and a low voltage sub-pixel in the selected sub-pixels by a preset data driving signal, and the preset data driving signal is an average signal of driving signals of two adjacent sub-pixels in one original same row.

12. The driving device of claim 8, acquiring an inversion signal and selecting sub-pixels in the same column to be driven by frame inversion according to the inversion signal.

13. The driving device of claim 7, wherein the first pixel unit and the second pixel unit are alternately arranged in the row direction and the column direction.

14. The driving device of claim 7, wherein the first pixel unit and the second pixel unit respectively comprise a first sub-pixel, a second sub-pixel and a third sub-pixel, and the first sub-pixel, the second sub-pixel and the third sub-pixel respectively correspond to a red sub-pixel, a green sub-pixel and a blue sub-pixel.

15. The driving device of claim 7, wherein the first pixel unit and the second pixel unit respectively comprise a first sub-pixel, a second sub-pixel and a third sub-pixel, and the first sub-pixel, the second sub-pixel and the third sub-pixel respectively correspond to a red sub-pixel, a green sub-pixel and a blue sub-pixel.

16. A display device, wherein the display device comprises a driving device of display panel, the driving device comprises a processor and a non-volatile memory, the non-volatile memory stores executable instructions, the processor executes the executable instructions, and the executable instructions comprise:

a common electrode driving module, being configured to take a time duration of scanning at least three adjacent columns of pixel unit as a driving period, driving a common electrode of each sub-pixel of the pixel unit with a preset voltage in a current driving period;

the common electrode driving module is further configured to drive the high voltage sub-pixels of the pixel unit with a positive polarity and driving the low voltage sub-pixels of the pixel unit with a negative polarity if the preset voltage is a negative polarity driving voltage, wherein the preset voltage is a negative polarity driving signal means that the preset voltage is less than a reference voltage;

an inverting module, being configured to invert the preset voltage periodically when a received data driving signal input by a data driving circuit is inverted; and the common electrode driving module is further configured to drive the high voltage sub-pixels of pixel unit with a negative polarity and drive the low voltage sub-pixels of the pixel unit with a positive polarity if the inverted preset voltage is a positive polarity driving voltage, wherein the inverted preset voltage is a positive polarity driving signal means that the inverted preset voltage is larger than the reference voltage.

17. The display device of claim 16, selecting two adjacent sub-pixels in the same row respectively, and driving a high voltage sub-pixel in the selected sub-pixels with the equivalent driving voltage that greater than the equivalent driving voltage of the low voltage sub-pixels in the selected sub-pixels.

18. The display device of claim 17, driving a high voltage sub-pixel in the selected sub-pixels with the equivalent driving voltage that is a differential voltage between the driving voltage for positive polarity driving and the preset voltage; and driving a low voltage sub-pixel in the selected sub-pixels with the equivalent driving voltage that is a differential voltage between the driving voltage for negative polarity driving and the preset voltage.

19. The display device of claim 17, driving an equivalent driving voltage of a high voltage sub-pixel and a low voltage sub-pixel in the selected sub-pixels by a preset data driving signal, and the preset data driving signal is an average signal of driving signals of two adjacent sub-pixels in one original same row.

* * * * *